US006718717B2

(12) United States Patent
Henderson et al.

(10) Patent No.: US 6,718,717 B2
(45) Date of Patent: Apr. 13, 2004

(54) MODULAR WALL PANEL AND MOUNTING MEMBER

(75) Inventors: J. Dennis Henderson, Alpharetta, GA (US); Todd Alan Shane, Marietta, GA (US)

(73) Assignee: Herman Miller Inc., Zeeland, MI (US)

( * ) Notice: Subject to any disclaimer, the term of this patent is extended or adjusted under 35 U.S.C. 154(b) by 116 days.

(21) Appl. No.: 09/742,838

(22) Filed: Dec. 20, 2000

(65) Prior Publication Data

US 2001/0047637 A1 Dec. 6, 2001

Related U.S. Application Data

(60) Provisional application No. 60/184,891, filed on Feb. 25, 2000.

(51) Int. Cl.[7] ..... E04C 2/00

(52) U.S. Cl. ..... 52/474; 52/475.1; 52/476; 52/483.1; 52/489.1; 52/800.1

(58) Field of Search ..... 52/474, 475.1, 52/476, 483.1, 489.1, 800.1, 578

(56) References Cited

U.S. PATENT DOCUMENTS 3,053,354 A * 9/1962 Dielman ..... 52/489.1
4,344,267 A * 8/1982 Sukolics ..... 52/762
4,449,344 A * 5/1984 Dodich ..... 52/475
4,571,907 A 2/1986 DeFouw et al.
4,685,255 A 8/1987 Kelley
4,738,067 A * 4/1988 Froseth ..... 52/478
RE32,890 E 3/1989 DeFouw et al.
4,832,152 A 5/1989 Schuelke et al.
4,876,835 A 10/1989 Kelley et al.
5,038,539 A 8/1991 Kelley et al.
5,040,318 A * 8/1991 Ryan ..... 40/396
5,086,597 A 2/1992 Kelley et al.
5,129,202 A 7/1992 Payne et al.
5,174,086 A 12/1992 Payne et al.
5,400,560 A * 3/1995 Hellwig et al. ..... 52/578
5,423,151 A 6/1995 Caro et al.
6,012,258 A * 1/2000 Brown et al. ..... 52/239

* cited by examiner

*Primary Examiner*—Jeanette Chapman
(74) *Attorney, Agent, or Firm*—Brinks Hofer Gilson & Lione

(57) ABSTRACT

A modular wall panel and mounting members for attaching a panel covering thereto. The modular wall panel has one or more flanges that connect to a frame support. A panel covering is tensioned across a face of the frame support and is connected to the flanges by the mounting members.

19 Claims, 5 Drawing Sheets

MODULAR WALL PANEL AND MOUNTING MEMBER

RELATED APPLICATION

This application claims the benefit of the filing date pursuant to 35 U.S.C. §119(e) of Provisional Application Ser. No. 60/184,891, filed Feb. 25, 2000, the disclosure of which is hereby incorporated by reference.

BACKGROUND OF THE INVENTION

The present invention relates generally to a modular wall panel. More particularly, the invention relates to wall panel and an improved mounting member for attaching a panel covering to the wall panel.

Open-plan office systems provide a series of rigid frames which, in turn, are rigidly connected together at facing edges to divide work spaces into work or task areas. Modular panels or tiles are removably mounted to the faces of both sides of the frame to provide a barrier. Such open-plan office systems are disclosed in U.S. Pat. No. 4,685,255 to Kelley, granted Aug. 11, 1987 and U.S. Pat. No. 4,832,152 to Schuelke et al. granted May 23, 1989.

In accordance with the above-identified patents, panels, such as metal pans, are provided with a fabric or a vinyl covering. In the past, the fabric or covering has typically been glued to the panels.

This method of attaching the covering to the panel presented a problem when different customers chose different panel coverings for their office system. Because of the difference in the nature of the fabrics and coverings, different glues were required for different coverings. However, certain coverings have been found unsuitable for any known glue. Further, even when the coverings are successfully glued to pans, some field conditions, such as fluctuating humidity, can result in ungluing of portions of the coverings from the pans.

An improvement on the gluing of the coverings is disclosed in U.S. Pat. No. 5,129,202, issued to Payne et al. The improvement consisted of a clip that was sewn to the panel covering and then was attached to the wall panel frame, thereby avoiding the use of adhesives. However, the sewing process is labor-intensive and is difficult to do inexpensively, especially outside a factory. Thus, this method of attachment limited the ability of a dealer to customize the wall panel with a particular fabric or covering according to a customer's preference.

SUMMARY

Therefore, there is a need in the art for a modular wall panel that can easily and inexpensively be provided with alternate panel coverings.

In one aspect of the invention, a modular wall panel is provided having a frame support that includes a front face defining a front side, a rear face defining a rear side, a first set of opposing end portions, and a flange connected with each of the opposing end portions, on the rear side of the frame support. A panel covering extends over at least a portion of the front face, and an end portion of the panel covering extends to each of the flanges.

The modular wall panel also includes one or more elongated mounting members associated with the flanges, the mounting members being detachable from the panel covering. The mounting members attach the panel covering to the flanges.

According to another aspect of the invention, a mounting member is provided for use in attaching a panel covering to a modular panel support frame. Other aspects of the invention will become apparent in view of following description of the preferred embodiments and the accompanying drawings.

DETAILED DESCRIPTION OF THE PREFERRED EMBODIMENTS

Figure 1:
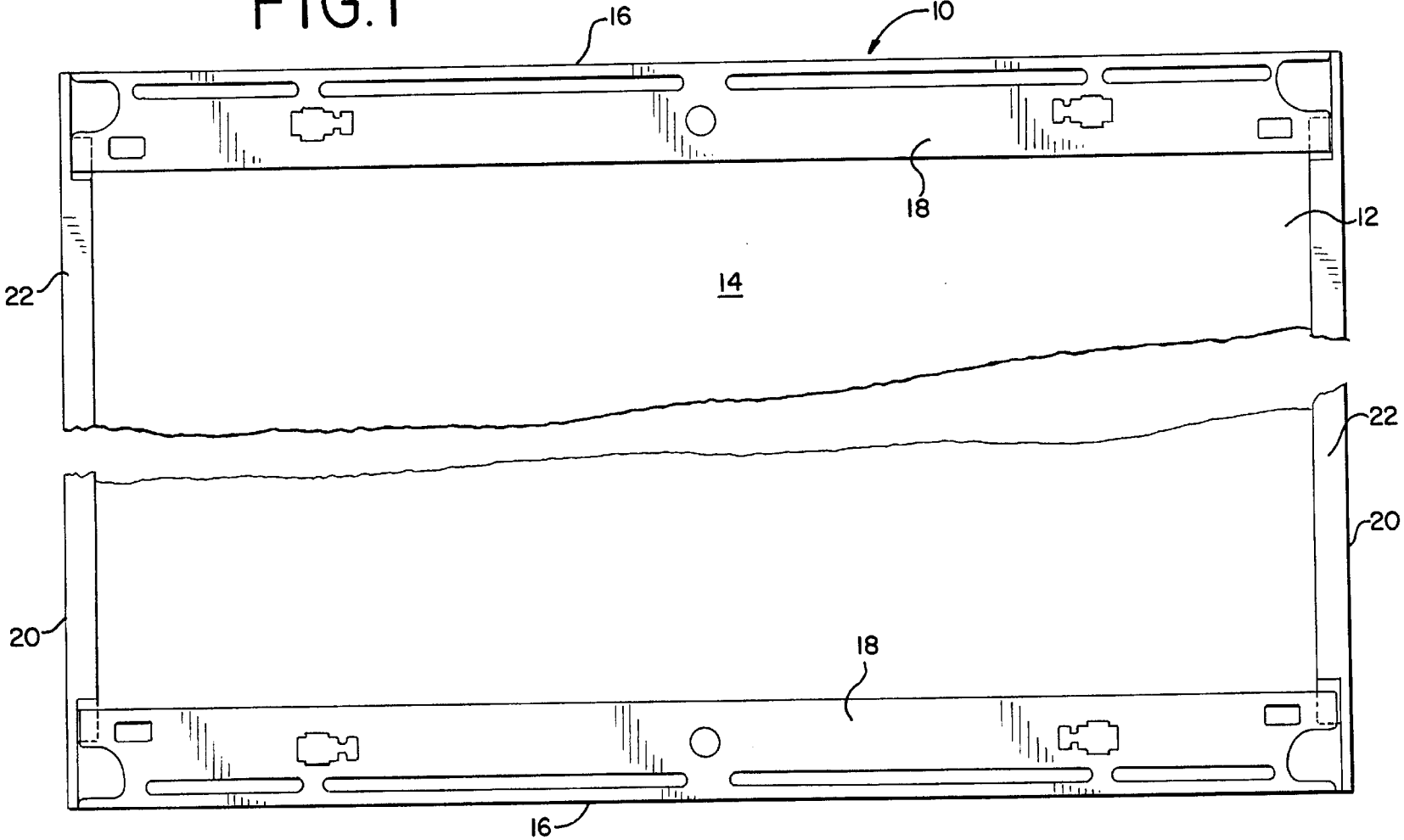
FIG. 1 is a top view of a rear face of the panel frame support according to one embodiment of the present invention.

Referring now to the drawings in general and FIG. 1 in particular, a modular wall panel is shown generally at 10. In the preferred embodiment, the wall panel 10 is rectangular in shape and is about 40.5 cm in width by about 60 cm in length. The wall panel 10 includes a frame support 12. In the embodiment shown, the frame support 12 is made from a sheet metal, such as twenty-four inch gauge cold rolled steel, and has an autophoretic coating applied to each of its faces. However, the frame support may alternatively be a tackable tile and/or have an acoustical insert, as disclosed in U.S. Pat. No. 5,423,151, which is incorporated herein by reference.

The frame support 12 includes a rear face 14 and a front face (not shown), both of which are preferably substantially planar. At end portions of the frame support are attached a first set of opposing sides 16, and a second set of opposing sides 20, both of which are more clearly seen in FIGS. 3 and 4. When the frame support 12 is formed of a sheet metal, as in the embodiment shown, the first and second set of sides 16 and 20 are preferably integrally formed by folding of the frame support 12 at a right angle. Furthermore, the frame support 12 includes a first set of return flanges 18 and a second set of return flanges 22 attached to the first set of sides 16 and the second set of sides 20, respectively. The return flanges 18 and 22 are also preferably intregally formed with the frame support 12 by further bending of sides 16 and 20.

Figure 2:
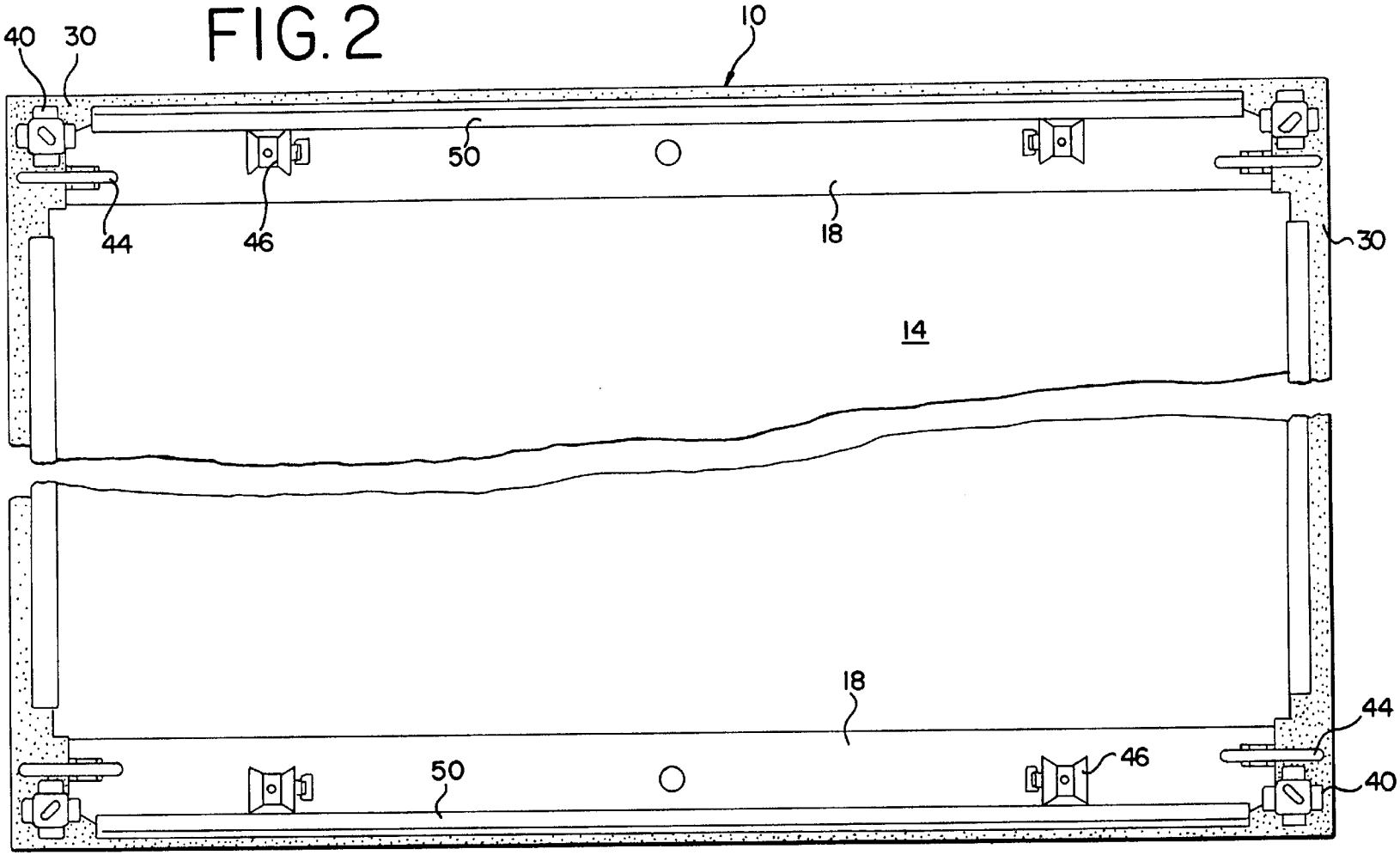
FIG. 2 is a top view of a rear face of a fully assembled modular wall panel according to one embodiment of the present invention.

The return flanges 18 and 22 are utilized for engagement by various mounting members to secure a panel covering tensioned across the front face of the frame support 12. FIG. 2 shows the fully assembled modular wall panel 10. A panel covering 30 is tensioned across the front face (not shown) of the frame support 12 and is attached to first set of return flanges 18 and the second set of return flanges 22 by various mounting members described in detail below. The panel covering 30 may be made from any material known in the art, such as a fabric or a vinyl sheet, and is chosen according to the preferences of a specific user of the modular panel.

Figure 3:
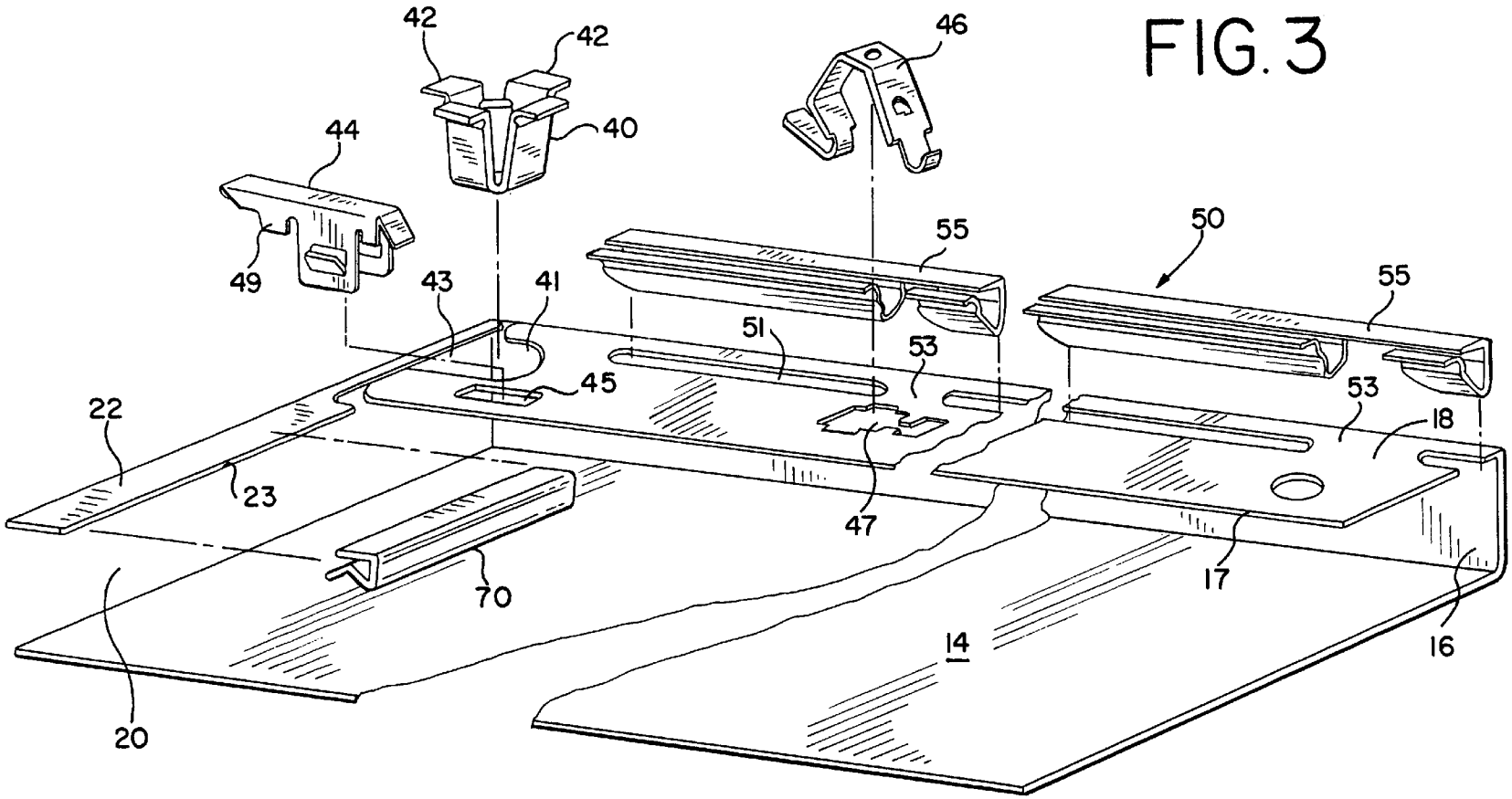
FIG. 3 is a partial exploded perspective view of the mounting members associated with the panel frame support according to the embodiment shown in FIGS. 1 and 2.
Figure 4:
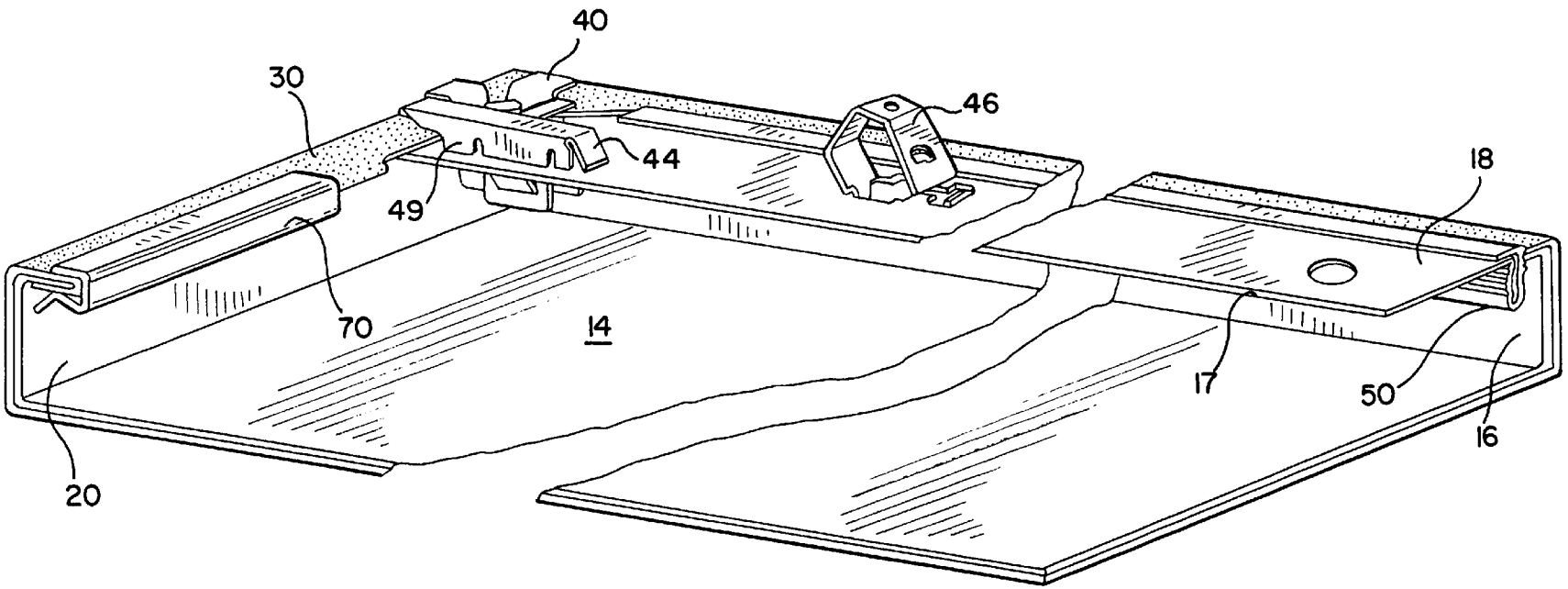
FIG. 4. is a partial perspective view of a fully assembled modular wall panel according to the embodiment shown in FIGS. 1 and 2.

The first set of return flanges 18 includes corner retaining members 40, hook mounting members 44, spring mounting members 46, and an elongated mounting member 50. As shown in FIGS. 3 and 4, spring mounting members 46 securedly engage stamped-out holes 47 of the first set of return flange 18, and is used to attach the modular wall panel 10 to a support structure in a manner similar to that of the spring clip 69 disclosed in U.S. Pat. No. 4,685,255, which is incorporated herein by reference. Hook mounting members 44 securedly engages holes 45, and include gripping arms 49 for assisting in securing the panel covering 30 in a tensioned relationship across the frame support 12 and the second set of sides 20. The hook mounting members 46 are also used to mount the modular wall panel on a supporting framework, and are similar to the hook clips 68 disclosed in U.S. Pat. No. 4,685,255. Likewise, corner retaining members 40 securedly engage a cutout portion 41 of the first set of return flanges 18 and a cutout portion 43 of the second set of return flanges 22. Preferably, the corner retaining members 40 are spring clips having a plurality of fingers 42 for gripping the panel covering 30 and assisting in maintaining the panel covering 30 in a tensioned relationship across the front face of the frame support 12 and the first set of and second set of sides 16, 20.

The modular wall panel 10 also includes elongated mounting members 50 securedly engaging a plurality of stamped-out slots 51 on each of the first set of return flanges 18. The elongated mounting members 50 each extend over a substantial portion of the length of their respective return flanges 18. The mounting members 50 function to grip and hold the panel covering 30 in a tensioned relationship across the front face (not shown) and first set of sides 16 of the frame support 12.

Although the mounting members 50 grip the panel covering 30, the mounting members 50 are detachable from the panel covering 30. By "detachable" it is meant that the mounting members 50 are not attached to the panel covering 30 in a manner (i.e., such as sewing) that is intended to result in a substantially permanent attachment, but rather are readily detached to allow an alternate panel covering 30 to be extended across the frame support 12.

Figure 5:
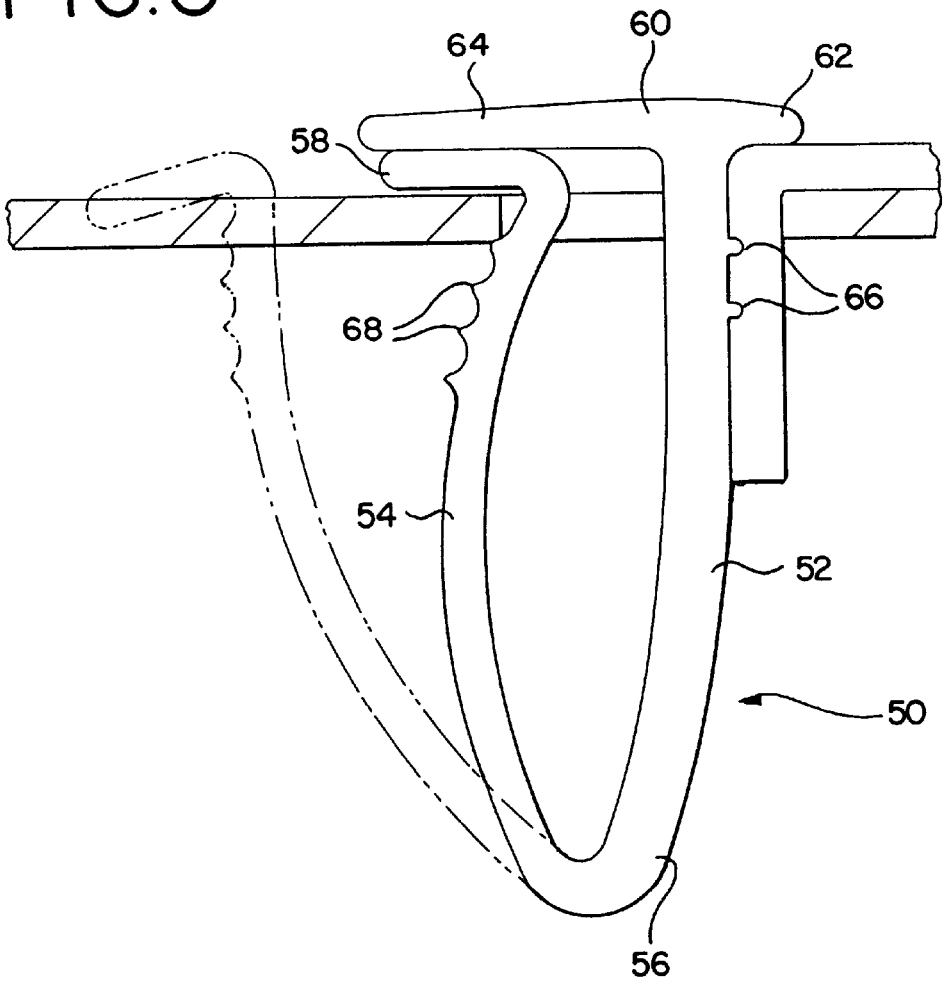
FIG. 5 is a cross-sectional view of a first elongated mounting member mounted in a wall panel in accordance with the embodiment shown in FIGS. 1 and 2.

FIG. 5 shows a cross-section of one embodiment of the elongated mounting member 50. In the embodiment shown, the elongated mounting member 50 is formed of a unitary body of a flexible, but resilient material, such as rigid polyvinylchloride. The mounting member 50 has a lower portion including a first leg 52 and a second leg 54, joined by a pivoting portion 56. The natural position of the mounting member is shown in phantom; when compressed, the mounting member 50 resides in the slot 51 in an insertion position as shown, with the lower portion of the mounting member below the slot.

The mounting member 50 is inserted into the slot 51 such that the first leg 52 is nearer the first set of sides 16 and the second leg 54 is nearer an edge 17 of first set of return flanges 18 (see FIGS. 3–4). The second leg 54 has a retaining extension 58 for engaging the first set of return flanges 18 and preventing the mounting member 50 from pushing through the slot 51. The first leg 52 terminates in a cap 60, which includes outward extension 62 and an inward extension 64. The outward extension 62 is directed at a substantially right angle to the first leg 52. The outward extension 62 engages and holds the panel covering 30 between the first set of return flanges 18 and the extension 62 itself, and also functions to prevent the mounting member 50 from pushing through the slot 51. The inward extension 64 is longer and extends over the retaining extension 58 of the second leg 54. The inward extension 64 serves both the functions of preventing the mounting member 50 from pushing through the slot 51, and to aid in the appearance of the completed wall modular panel by providing a flat continuous surface when viewed from above (see FIG. 2). Together, the cap 60 and the retaining extension 58 form an upper portion of the mounting member and reside on a side of the slot opposite the lower portion.

The first leg 52 includes a plurality of longitudinal ribs 66 for gripping the panel covering 30 and for preventing the mounting member 50 from being pushed up through the slot 51. The second leg 54 also includes a plurality of longitudinal ribs 68 for preventing the mounting member 50 from being pushed up through the slot 51. A multiplicity of ribs 66 and 68 allow variance of the thickness of panel covering 30. For example, as in the embodiment shown, a relatively thin panel covering 30 would require use of the top rib of ribs 66 and the top rib of ribs 68, whereas a relatively thick panel covering would utilize the bottom rib of ribs 66 and the bottom rib of ribs 68.

As shown in FIG. 3, the slot 51 may include a plurality of slots which are separated by one or more contiguous portions 53 of the first set of return flanges 18. Rather than providing a plurality of elongated mounting members 50, one for each slot 51, a single elongated mounting member 50 may be provided having first and second legs removed in sections corresponding to contiguous portions 53. In such cases, a web 55 integral with cap 60 connects the sections of elongated mounting member 50. Those skilled in the art will appreciate that in other embodiments a plurality of separate elongated mounting members 50 may be provided, one for each slot 51.

In preferred embodiments, the elongated mounting member 50 is sized to run a substantial portion of the length of its respective flange 18. In embodiments where more than one elongated mounting member is provided per flange, the sum of the lengths of the elongated mounting members 50 cover a substantial portion of the length of the flange 18. In more preferred embodiments, the elongated mounting member(s) 50 runs at least about one-half the length of its respective flange 18, and more particularly at least about three-fourths the length of its respective flange. In even more preferred embodiments, the elongated mounting member(s) 50 runs about nine-tenths the length of its respective flange 18. In the embodiment shown in the FIGURES, the elongated mounting member 50 is approximately 35 cm long, and the flange 18 is approximately 39.5 cm long.

As shown in FIG. 3, the modular wall panel 10 also includes elongated mounting members 70 securedly engaging an edge 23 on each of the second set of return flanges 22. In preferred embodiments of the invention, the mounting members 70 have a shape distinct from mounting members 50, as described more fully below. The elongated mounting members 70 each extend over a substantial portion of the length of their respective second set of return flanges 22. The elongated mounting members 70 function to grip and hold the panel covering 30 in a tensioned relationship across the front face (not shown) and second set of sides 20 of the frame support 12.

Although the mounting members 70 grip the panel covering 30, the mounting members 70 are detachable from the panel covering 30. By "detachable" it is meant that the mounting members 70 are not attached to the panel covering 30 in a manner (i.e., such as sewing) that is intended to result in a substantially permanent attachment, but rather may be readily detached to allow an alternate panel covering 30 to be extended across the frame support 12.

Figure 6:
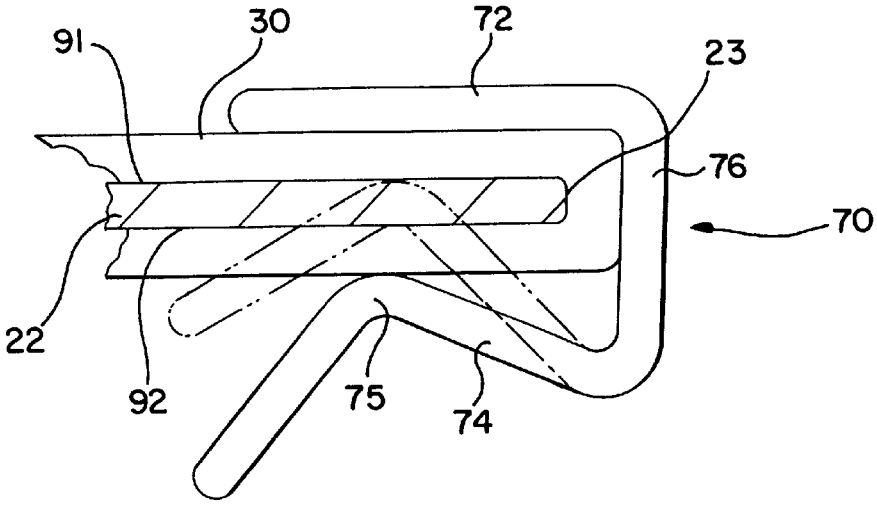
FIG. 6 is a cross sectional view of a second elongated mounting member mounted in a wall panel in accordance with the embodiment shown in FIGS. 1 and 2.

FIG. 6 shows a cross-section of the elongated mounting member 70 attached to a flange of the second set of return flanges 22. The elongated mounted member 70 preferably has a unitary body made from a flexible, but resilient material, such as rigid polyvinylchloride. The mounting member 70 includes a top extension 72, a bottom extension 74, and a connecting extension 76. The bottom extension 74 includes a bend 75. The top extension 72 grips the panel covering 30 between itself and an outer surface 91 of the return flange 22. Likewise, the bottom extension 74 grips the panel covering 30 between itself and an inner surface 92 of the return flange 22.

FIG. 6 shows the natural position of the unitary body of the mounting member 70 in phantom. When in an expanded, assembled position as shown in FIG. 6, the bend 75 of bottom extension 74 exerts force upon the panel covering 30 and the inner surface 92, thereby securing both the panel covering 30 in a tensioned relationship across the frame support 12, as well as securing the mounting member 70 to the edge 23.

In preferred embodiments, the elongated mounting member 70 is sized to run a substantial portion of the length of its respective flange 22. The elongated mounting member 70 may consist of a single member, or may include a series of members. In embodiments where more than one elongated mounting member is provided per flange, the sum of the lengths of the elongated mounting members 70 cover a substantial portion of the length of the flange. In more preferred embodiments, the elongated mounting member(s) 70 runs at least about one-half the length of its respective flange 22, and more particularly at least about three-fourths the length of its respective flange. In even more preferred embodiments, the elongated mounting member(s) 70 run about nine-tenths the length of its respective flange 22. In the embodiment shown in the FIGURES, the elongated mounting member 70 is approximately 52 cm long, and the flange 18 is approximately 55.3 cm long.

It should be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention.

Accordingly, while the present invention has been described herein in detail in relation to several embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A modular panel comprising:

a frame support having a front face defining a front side, a rear face defining a rear side, a first set of opposing end portions, and a flange connected with each of said opposing end portions on the rear side of said frame support;

a fabric panel covering extending over at least a portion of said front face, a portion of said fabric panel covering extending to each said flange; and at least one elongated mounting member associated with at least one of said flanges, said mounting member readily detachable from said fabric panel covering, said mounting member attaching said fabric panel covering to said at least one of said flanges, wherein said mounting member is sized to extend a substantial portion of the length of said at least one of said flanges.

2. The modular panel of claim 1, wherein said mounting member is attached to an edge of said at least one of said flanges.

3. The modular panel of claim 2, wherein said mounting member comprises a resilient unitary body biased to a contracted position.

4. The modular panel of claim 1, wherein said at least one of said flanges further comprises at least one slot, and wherein said mounting member is attached to said at least one slot.

5. The modular panel of claim 4, wherein an upper portion of said mounting member is located on one side of said slot, and a lower portion is located on the other side of said slot.

6. The modular panel of claim 5, wherein said mounting member comprises a resilient unitary body biased to an expanded position.

7. A modular panel comprising:

a frame support having a front face defining a front side, a rear face defining a rear side, a first set of opposing end portions, a second set of opposing end portions, a first set of flanges connected with said first set of opposing end portions, a second set of flanges connected with said second set of opposing end portions;

a panel covering extending over at least a portion of said front face, a portion of said panel covering extending to each said flange; and a first set of elongated mounting members adapted to secure a portion of said panel covering to said first set of flanges, and a second set of mounting members adapted to secure said panel covering to said second set of flanges, said first set and second set of mounting members detachable from said panel covering, said first set of mounting members having a shape distinct from said second set of mounting members.

8. The modular panel of claim 7, wherein each flange of said first set of flanges further comprises an edge, and each respective mounting member of said first set of mounting members is attached to said edge.

9. The modular panel of claim 8, wherein each flange of said second set of flanges further comprises at least one slot, and each respective mounting member of said second set of mounting members is attached to said at least one slot.

10. The modular panel of claim 9, wherein each flange of said first set of flanges has an inner and an outer surface, each mounting member of said first set holding said panel covering against both said inner surface and said outer surface of its respective flange.

11. The modular panel of claim 10, wherein each mounting member of said first set comprises a top portion holding said panel covering against said outer surface, and a bottom portion holding said panel covering against said inner surface.

12. The modular panel of claim 11, wherein said bottom portion further comprises a bend contacting said panel covering.

13. The modular panel of claim 9, wherein an upper portion of each of said mounting members of said second set is located on one side of said slot, and a lower portion is located on the other side of said slot.

14. The modular panel of claim 13, wherein said lower portion comprises a first leg and a second leg.

15. The modular panel of claim 14, wherein said panel covering contacts said first leg.

16. The modular panel of claim 15, wherein said upper portion comprises a first extension connected with said second leg, and a cap connected with said first leg.

17. The modular panel of claim 16, wherein said first leg comprises a plurality of spaced longitudinal ribs.

18. The modular panel of claim 17, wherein said second leg comprises a plurality of spaced longitudinal ribs.

19. The modular panel of claim 7, wherein each flange of said second set of flanges comprises a plurality of slots separated by contiguous portions of the flange, and each mounting member of said second set comprises a plurality of sections corresponding to said slots, a web integral with said cap connecting said sections over said contiguous portions of the respective flange.

* * * * *